US007805292B2

(12) United States Patent
Huo et al.

(10) Patent No.: US 7,805,292 B2
(45) Date of Patent: Sep. 28, 2010

(54) METHOD AND APPARATUS FOR AUDIO TRANSCODING

(75) Inventors: Jiaquan Huo, Broadway (AU); Mohamad Raad, Cringila (AU); Jianwei Wang, Killarney Heights (AU); Marwan A. Jabri, Tiburon, CA (US)

(73) Assignee: Dilithium Holdings, Inc., Petaluma, CA (US)

( * ) Notice: Subject to any disclaimer, the term of this patent is extended or adjusted under 35 U.S.C. 154(b) by 827 days.

(21) Appl. No.: 11/738,822

(22) Filed: Apr. 23, 2007

(65) Prior Publication Data

US 2007/0288234 A1 Dec. 13, 2007

Related U.S. Application Data

(60) Provisional application No. 60/793,981, filed on Apr. 21, 2006.

(51) Int. Cl.
*G10L 21/00* (2006.01)
*G10L 19/00* (2006.01)

(52) U.S. Cl. ..... 704/201; 704/219; 704/230; 704/500

(58) Field of Classification Search ..... None
See application file for complete search history.

(56) References Cited

U.S. PATENT DOCUMENTS 6,260,009 B1 * 7/2001 Dejaco ..... 704/221
6,829,579 B2 12/2004 Jabri et al.
7,307,981 B2 * 12/2007 Choi et al. ..... 370/352
7,315,815 B1 * 1/2008 Gersho et al. ..... 704/223
2003/0014249 A1 1/2003 Ramo
2003/0142699 A1 * 7/2003 Suzuki et al. ..... 370/535
2005/0159943 A1 * 7/2005 Zinser et al. ..... 704/219
2005/0228651 A1 10/2005 Wang et al.
2006/0074644 A1 4/2006 Suzuki et al.

FOREIGN PATENT DOCUMENTS

WO WO 03/049081 A1 6/2003

OTHER PUBLICATIONS

Andersen et al., "ILBC—A Linear Predictive Coder with Robustness to Packet Loss", Speech Coding, IEEE Workshop Proceedings, pp. 23-25, Oct. 2002.*
International Search Report and Written Opinion of PCT Application No. PCT/US08/67220, dated Mar. 12, 2008, 11 pages total.

* cited by examiner

*Primary Examiner*—Brian L Albertalli
(74) *Attorney, Agent, or Firm*—Townsend and Townsend and Crew LLP

(57) ABSTRACT

An apparatus for transcoding an audio signal between a CELP-based coder and a hybrid coder includes a source bitstream unwrapper configured to receive a source bitstream, extract one or more CELP compression parameters from the source bitstream, and construct an audio signal vector from the source bitstream while maintaining the one or more extracted CELP compression parameters. The apparatus also includes a frame interpolator coupled to the source bitstream unwrapper and a compression parameter converter coupled to frame interpolator. The compression parameter converter is configured to calculate output compression parameters from at least one of the interpolated compression parameters or the one or more extracted CELP compression parameters. Additionally, the apparatus includes a destination bitstream wrapper coupled to the compression parameter converter and a mapping parameter tuner coupled to the frame interpolator. The mapping parameter tuner is configured to select one or more parameters for use by the compression parameter converter.

39 Claims, 13 Drawing Sheets

METHOD AND APPARATUS FOR AUDIO TRANSCODING

CROSS-REFERENCES TO RELATED APPLICATIONS

This present application claims priority to U.S. Provisional Patent Application No. 60/793,981, filed on Apr. 21, 2006, commonly owned, and hereby incorporated by reference for all purposes.

BACKGROUND OF THE INVENTION

The present invention relates generally to the field of processing telecommunications signals. More particularly, the invention provides a method and apparatus for voice transcoding from a CELP based voice compression codec to a hybrid based voice compression codec (i.e. a codec that uses both CELP and non-CELP parameters). Merely by way of example, the invention has been applied to transcoding from the GSM-AMR codec to the internet Low Bitrate Codec (iLBC), but it would be recognized that the invention may also include other applications.

Modern communication systems rarely transmit uncompressed signals. Instead, signals are compressed to allow efficient utilization of spectrum resources. Compression of signals is generally performed by removing statistical and perceptual redundancy in the signal. In the process of compression, a block (known as a frame) of uncompressed samples is represented by a set (also known as a frame) of compression parameters. The compression parameters are subsequently quantized. The quantization indices for the compression parameters are organized into a bitstream. In the decompression process, the quantized compression parameters are extracted from the bitstream and used to construct a signal that replicates the original and may or may not be exactly the same. Typically, compression systems aim to produce perceptually similar signals to the original but in some cases exact replicas are also produced.

A number of standardized compression systems, which will from this point on be referred to as codecs, are based on the Code Excited Linear Prediction (CELP) algorithm (for example, the ITU's G.723.1 and the GSM's AMR codecs). CELP based codecs are popular for speech signal compression in mobile networks. CELP based codecs represent a speech signal by a linear prediction filter and an excitation signal. The excitation signal is vector quantized with a codebook that contains an adaptive section (referred to as the adaptive codebook, in which the code words are constructed from past quantized excitation signal samples) and a fixed or innovation section (where the code words are extracted from a static codebook).

Different networks follow different formats in compressing signals (i.e., different terminals on the same network may also use different formats). Recently, the internet Low Bitrate Codec (iLBC),has been introduced for voice over internet protocol (VoIP) applications. The main feature that makes iLBC suitable for VoIP application is its graceful performance degradation in the presence of packet loss, which is typical in Internet Protocol (IP) networks. Packet loss tolerance is achieved by quantizing the excitation signal of each frame independently of other frames.

In order to ensure that different terminals using different audio (of which speech is a subset) codecs can communicate, converting bitstreams of different formats is generally necessary. A straightforward way of carrying out a bitstream conversion task is by cascading a source bitstream decoder and a destination bitstream encoder in sequence. This is known as the tandem solution. Although the tandem solution is conceptually simple, actual implementation generally requires extensive computations and a tandem solution does not make effective use of the parameters used in the already encoded incoming bitstream. Thus, there is a need in the art for improved methods and systems for transcoding CELP based voice compression codec to a hybrid based voice compression codec in a more efficient manner.

SUMMARY OF THE INVENTION

According to an embodiment of the present invention an apparatus for transcoding an audio signal between a CELP-based coder and a hybrid coder is provided. The apparatus includes a source bitstream unwrapper configured to receive a source bitstream, extract one or more CELP compression parameters from the source bitstream, and construct an audio signal vector from the source bitstream while maintaining the one or more extracted CELP compression parameters. The apparatus also includes a frame interpolator coupled to the source bitstream unwrapper. The frame interpolator is configured to interpolate the one or more extracted CELP compression parameters and the constructed audio signal vector between a source frame rate and a destination frame rate and a source subframe rate and a destination subframe rate. The apparatus further includes a compression parameter converter coupled to frame interpolator. The compression parameter converter is configured to calculate output compression parameters from at least one of the interpolated compression parameters or the one or more extracted CELP compression parameters. Moreover, the apparatus includes a destination bitstream wrapper coupled to the compression parameter converter. The destination bitstream wrapper is configured to construct a destination bitstream. Additionally, the apparatus includes a mapping parameter tuner coupled to the frame interpolator. The mapping parameter tuner is configured to select one or more parameters for use by the compression parameter converter.

According to another embodiment of the present invention, a method of converting a CELP based bitstream to an iLBC bitstream is provided. The method includes processing the source CELP bitstream to extract one or more CELP compression parameters from the source CELP bitstream, synthesizing audio signal vectors from the CELP compression parameters, and aligning source and destination frame timing if the CELP based bitstream and the iLBC bitstream are characterized by at least one of a different frame rate or a different subframe rate. The method also includes selecting one or more algorithmic parameters for use in a destination compression parameter calculation based on the one or more CELP compression parameters and the synthesized audio signal vectors and calculating and quantizing one or more destination compression parameters using the one or more CELP compression parameters and the synthesized audio signal vectors. The method further includes wrapping the one or more destination compression parameters to provide the iLBC bitstream.

Embodiments of the present invention provide a transcoding method between CELP-based coders and hybrid coders that use some CELP-like elements. Embodiments of the present invention provide numerous benefits. For example, an embodiment of the present invention provides a low complexity transcoder apparatus, offering reduced resource consumption. Additionally, embodiments provide a high quality transcoder with the transcoded signal being perceived as being of higher quality than a transcoded signal produced using a tandem method. Further, embodiments provide a transcoder apparatus that uses less memory than a tandem transcoder of a CELP-based decoder with a hybrid encoder. Furthermore, other embodiments provide real time, low delay transcoding. Depending upon the embodiment, one or more of these benefits, as well as other benefits, may be achieved.

The objects, features, and advantages of the present invention, which to the best of our knowledge are novel, are set forth with particularity in the appended claims. Embodiments of the present invention, both as to their organization and manner of operation, together with further objects and advantages, may best be understood by reference to the following description, taken in connection with the accompanying drawings.

DETAILED DESCRIPTION OF SPECIFIC EMBODIMENTS

As discussed previously, a tandem solution to transcoding is conceptually simple. However, the tandem solution is also computationally demanding. As analysis on the speech signal has been performed by the source bitstream encoder in the case of a CELP based codec, it is desirable to make use of the source compression parameters to assist in the computation of the destination compression parameters. By so doing, substantial computational saving can be achieved with marginal or no speech quality degradation, and in some cases the reuse of the information actually allows for an increase in quality over a tandem bitstream. In this document, this approach is referred to as the smart bitstream conversion method.

Embodiments of the present invention provide methods and systems for conversion of a CELP based bitstream to a corresponding hybrid bitstream, an example of which is an iLBC bitstream. Methods and apparatuses for smart bitstream conversion have been reported in the prior art (see, for example, U.S. Pat. No. 6,829,579 issued to Jabri, et al. and entitled "Transcoding method and system between CELP based speech codes." Computational requirements for obtaining destination compression parameters are substantially reduced by the methods and systems provided herein by exploring the similarity between the source compression format and the destination compression format. However, the source and destination codecs targeted in some of these methods share very similar codebook structures.

This similarity in codebook structure does not exist between a CELP based codec and a hybrid codec such as the iLBC. Unlike most CELP based coders, iLBC frames are encoded on a frame-by-frame basis with no reference to the past or future frames. Furthermore, the iLBC uses a 3-stage adaptive codebook, instead of the adaptive-fixed combination as used in CELP based codecs. Moreover, the iLBC codebook may contain decoded signal segments in the past or the future (as long as they are in the same frame of the current segment being coded), depending on the relative time location between the reference signal and the target signal. These differences between a CELP based codec, such as GSM-AMR, and a hybrid codec, such as iLBC, mean that the parameters of each codec may represent different physical quantities. In turn, these differences mean that there is a need to develop efficient, high quality transcoders that can extract one set of parameters from the other while accounting for the physically different quantities each set represents. Thus, embodiments of the present invention differ from, for example, CELP-to-CELP transcoders or speech-to-CELP codecs.

Figure 1:
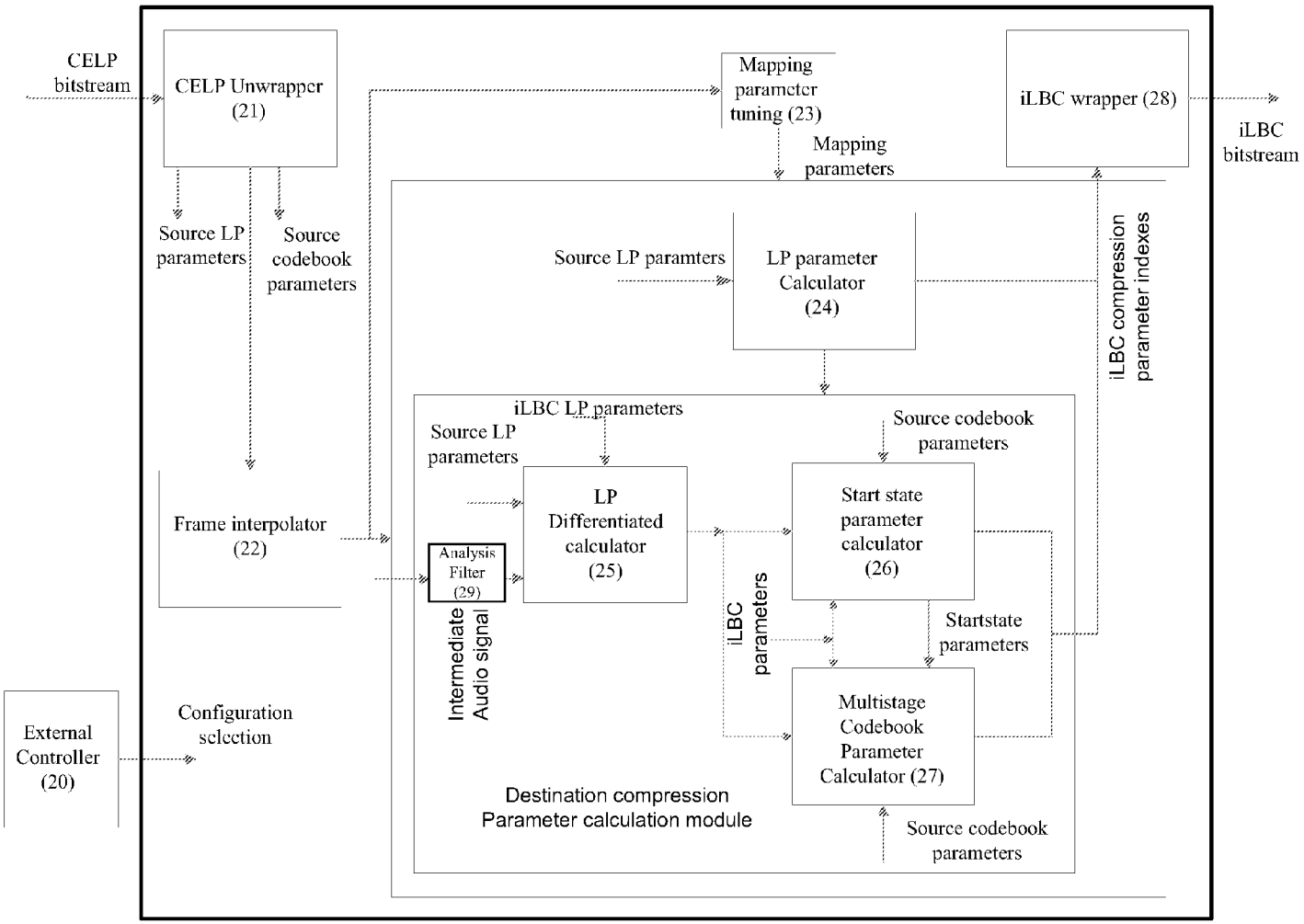
FIG. 1 is a top level block diagram of a transcoder according to an embodiment of the present invention.

FIG. 1 is a top level block diagram of a transcoder according to an embodiment of the present invention. The source compression parameters are extracted from the source bitstream and an audio signal is synthesized from the source compression parameters. The source compression parameters, along with the intermediate audio signal, may be buffered in the frame interpolation module if the source and the destination bitstreams are of different frame rates. The CELP parameters, along with the intermediate audio signal, can be analyzed and classified by a Mapping Parameter Tuning module and a mapping strategy with tuned mapping coefficients can be selected for the destination hybrid codec. This information may in turn be used for setting one or more algorithmic parameters used in the destination compression parameter calculation module. The destination parameter calculation module includes a CELP parameter calculation module and a non-CELP parameter calculation module. The CELP parameter calculation module in the iLBC hybrid codec is an LP parameter calculation module, while the non-CELP parameter calculation module is a multistage codebook parameter calculation module.

The LP parameter module takes one or more source LP parameters and converts them to one or more destination LP parameters. Methods for converting the source LP parameters to the destination LP parameters are described in additional detail throughout the present specification. With the destination LP parameters so obtained, the intermediate audio signal is calibrated by an LP difference calculation module, which takes into account the difference between the source and destination codecs linear prediction model due to the quantization of the LP coefficients.

A Start state section, which is used in the compression of other signal segments, is then identified in the residual signal and quantized to obtain a set of Start state parameters. The set of Start state parameters includes a Start state position indicating the first of the two consecutive subframes holding the Start state section, a Startstate_first flag indicating the location of the Start state at the beginning section or ending section of the consecutive subframes, and a Start state scale parameter that normalizes the signal samples in the Start state for quantization and a plurality of Start state quantized (using ADPCM) sample values.

The remaining sub-blocks in a residual signal frame may then be processed to generate a set of multistage codebook parameters. The destination LP parameters, the Start state parameters, and the multistage codebook parameters are finally wrapped into a destination bitstream for output. An external control signal may be used to configure the transcoder.

Figure 2:
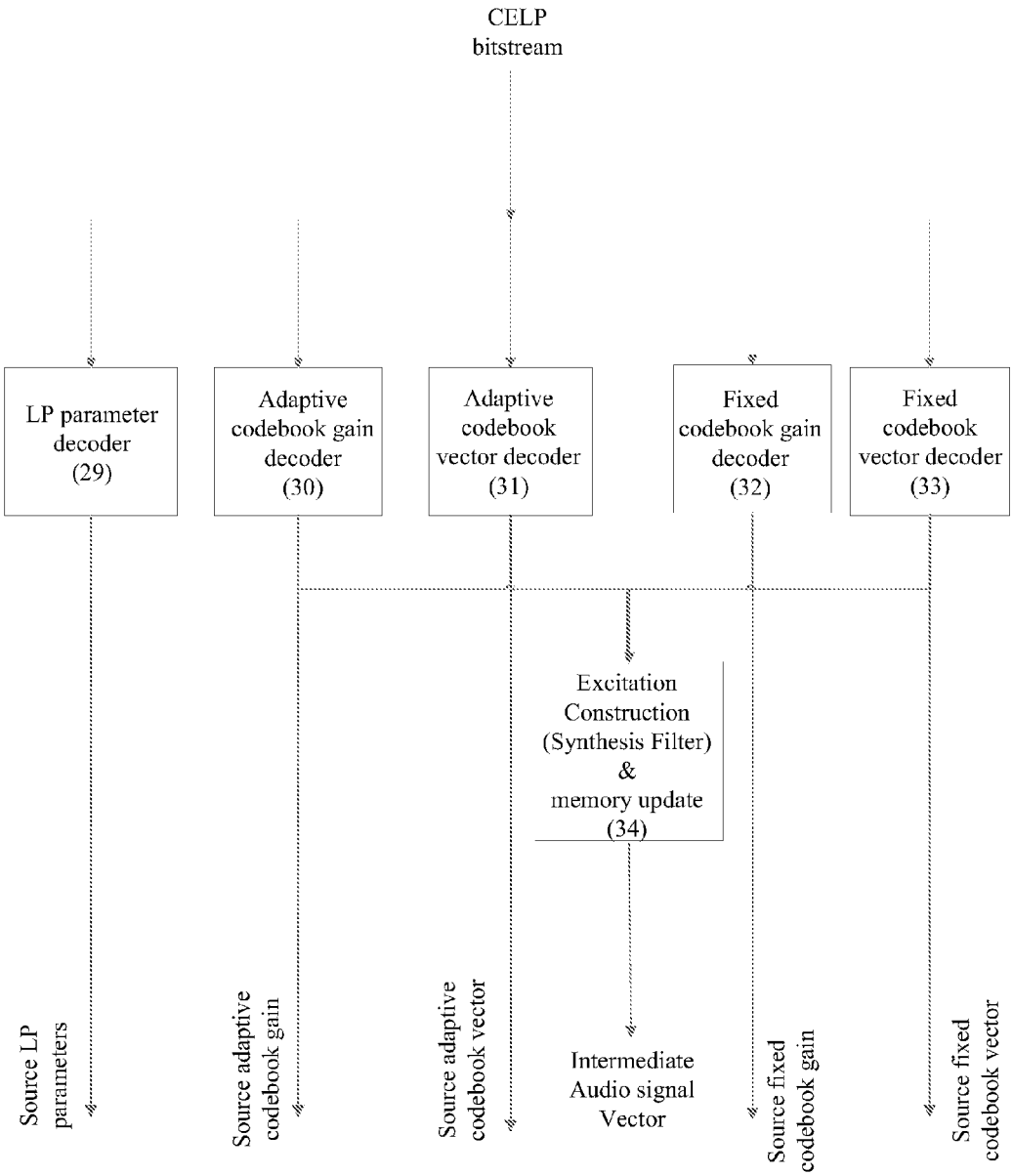
FIG. 2 is a block diagram illustrating a CELP unwrapper module according to an embodiment of the present invention.

FIG. 2 illustrates a bitstream unwrapper according to an embodiment of the present invention. Source compression parameters are extracted by the respective parameter decoders. The codebook parameters are used to construct an excitation signal and an audio signal.

Figure 3:
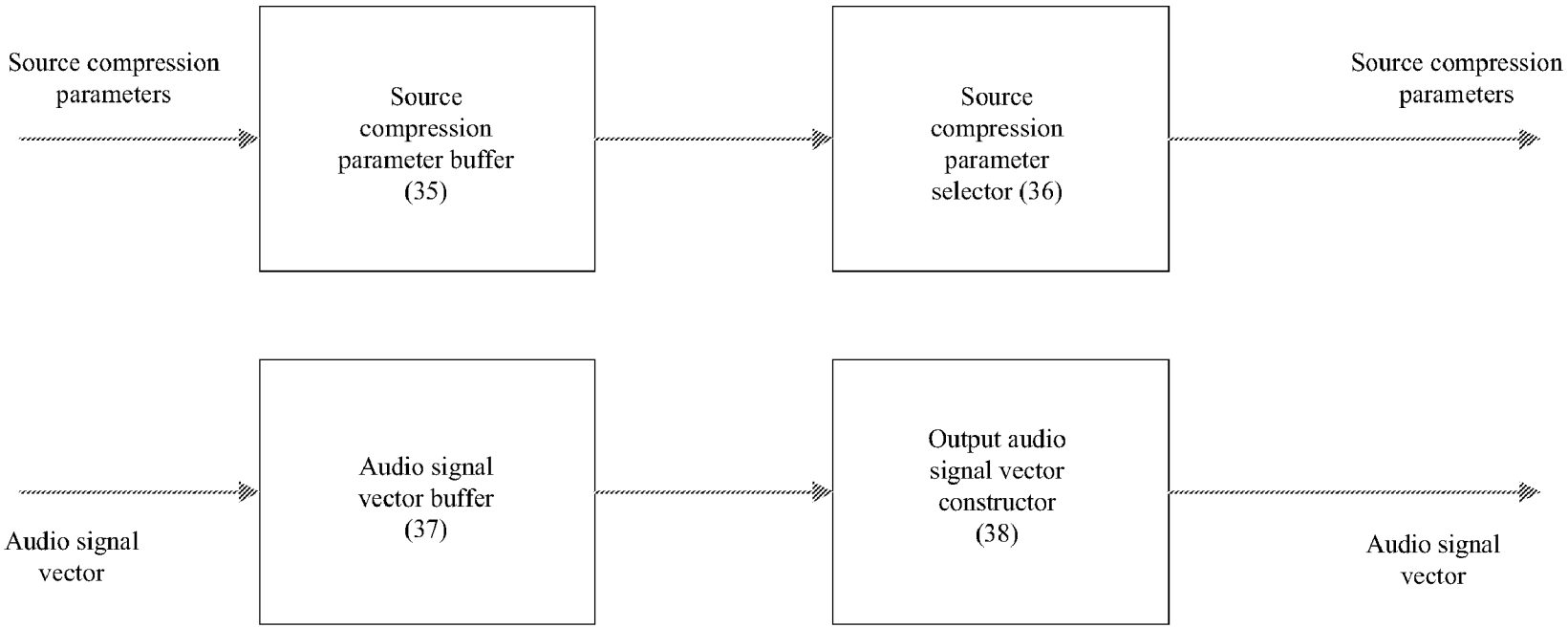
FIG. 3 is a block diagram illustrating a frame interpolator according to an embodiment of the present invention.

FIG. 3 is a block diagram illustrating a frame interpolator according to an embodiment of the present invention. Frame interpolation is performed by buffering the source compression parameters and the audio signal. Following the interpolation, an output of source compression parameters and the sections of the audio signal for subsequent processing is provided.

Figure 4:
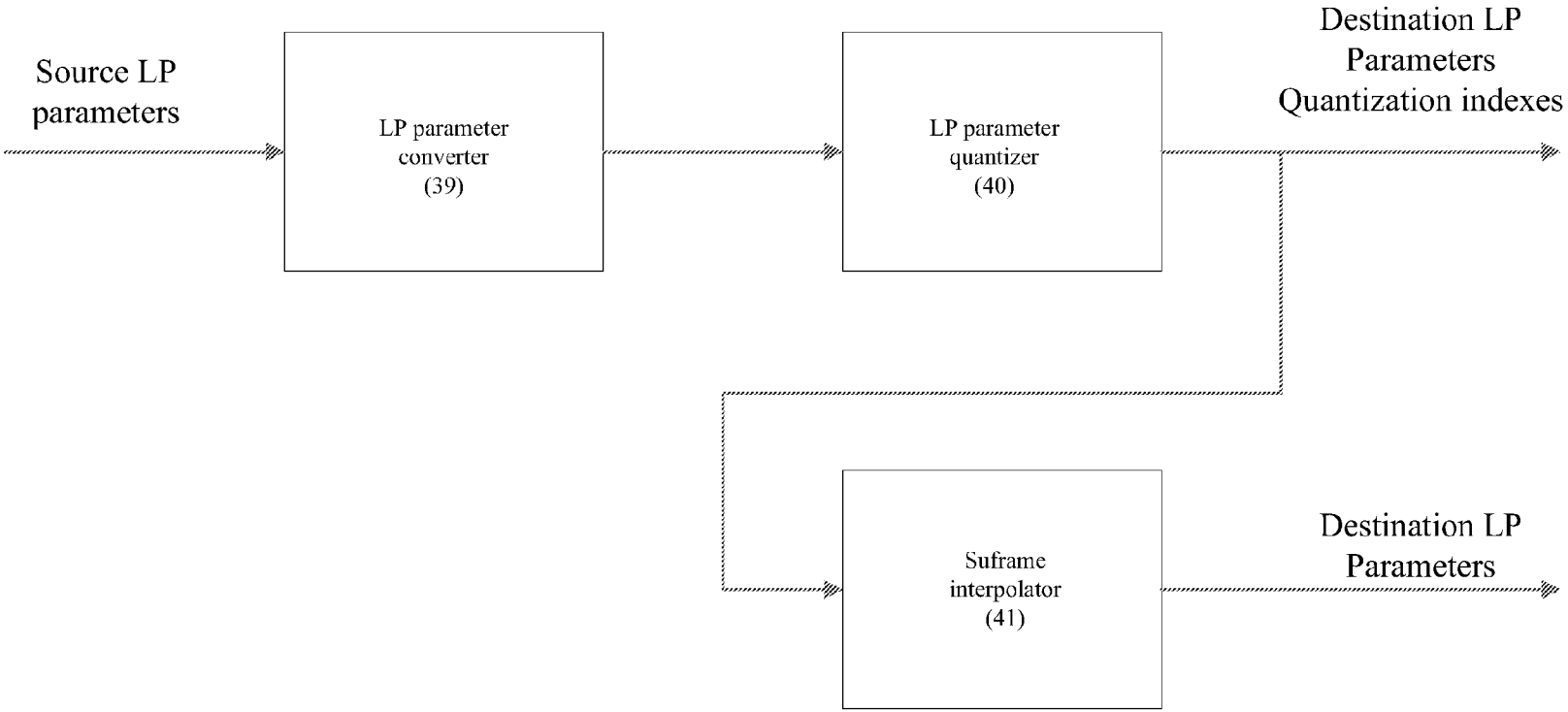
FIG. 4 is an internal functional diagram illustrating an LP parameter converter according to an embodiment of the present invention.

FIG. 4 shows an LP parameter converter according to an embodiment of the present invention. Destination LP parameters are obtained by converting the source LP parameters using a variety of methods. For example, the four methods illustrated by FIG. 8 may be used. Then the destination LP parameters are vector quantized. The quantized destination LP parameters are then output for bitstream wrapping. They are further interpolated to obtain LP parameters for each destination subframe. In a particular embodiment, the interpolated LP parameters are used in the analysis filtering in codebook parameter calculation.

Figure 5:
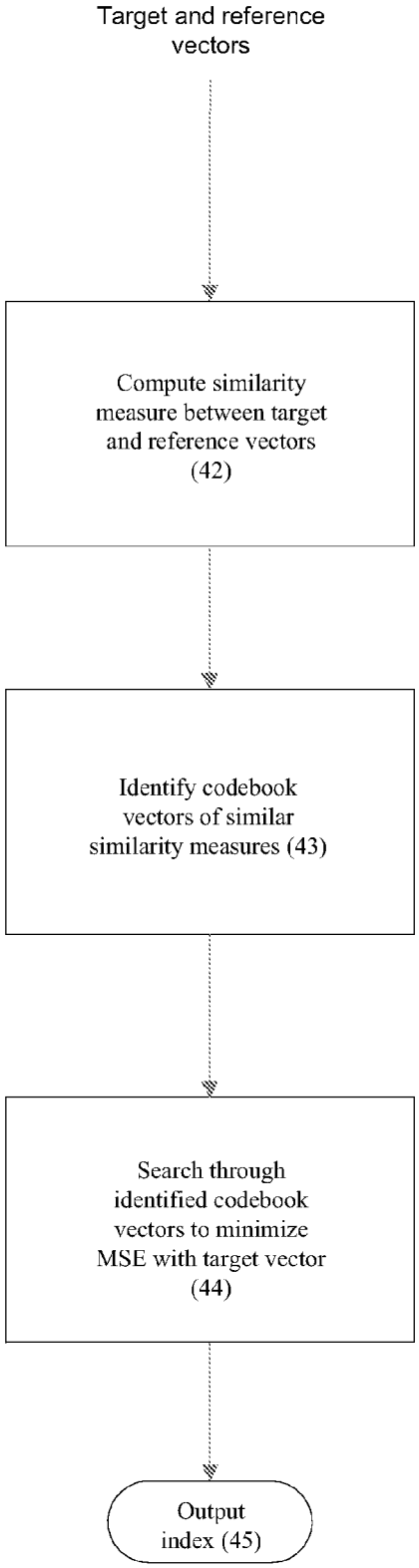
FIG. 5 is a flowchart illustrating a fast vector quantization algorithm according to an embodiment of the present invention.

FIG. 5 presents a fast vector quantization technique that can be used for the quantization of any vector, not just LP parameters. This fast vector quantization is based on sorting the VQ (Vector Quantization) codebook based on the similarities between the codebook vectors and a reference vector. One example for a measure of similarity is the correlation between two vectors. The similarity measures between the codebook vectors and the reference vector may be computed and sorted offline. On quantizing a target vector, the similarity measure between the target and the reference vector is computed. The codebook vectors of similarity measures that are within a pre-described neighborhood of the target-reference similarity measure are identified. A codebook vector that is closest to the target vector is found in these identified codebook vectors and its index is output.

Figure 6:
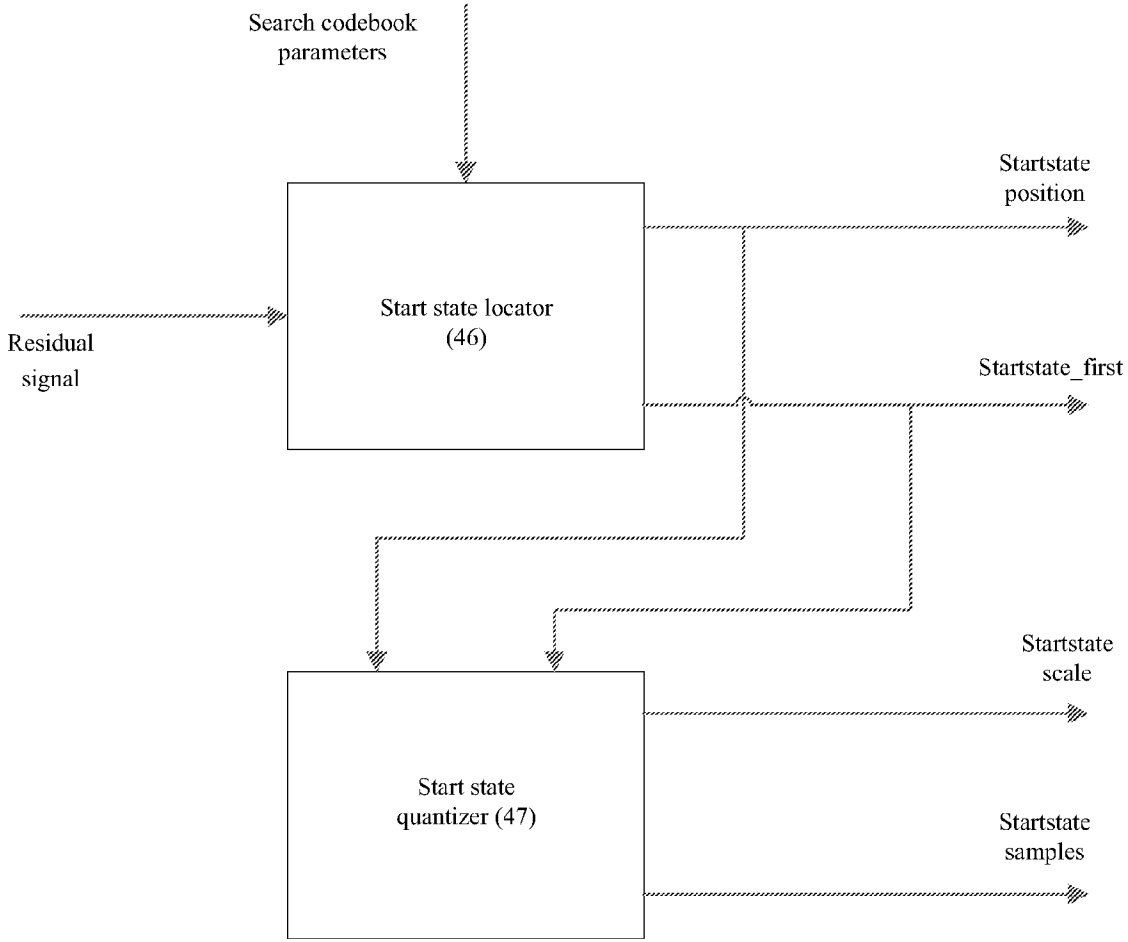
FIG. 6 is a block diagram illustrating a Start state parameter calculation module according to an embodiment of the present invention.

FIG. 6 shows how Start state parameters may be obtained. A Start state section may be first located within a frame of a calibrated intermediate audio signal by either a hybrid search or a residual domain search. The located Start state section is then quantized to obtain the quantized Start state samples. In order to provide uniform quantization performance for signals of different strengths, the Start state section may be normalized by its largest magnitude sample before being quantized. This sample is processed to yield the Start state scale parameter.

Figure 7:
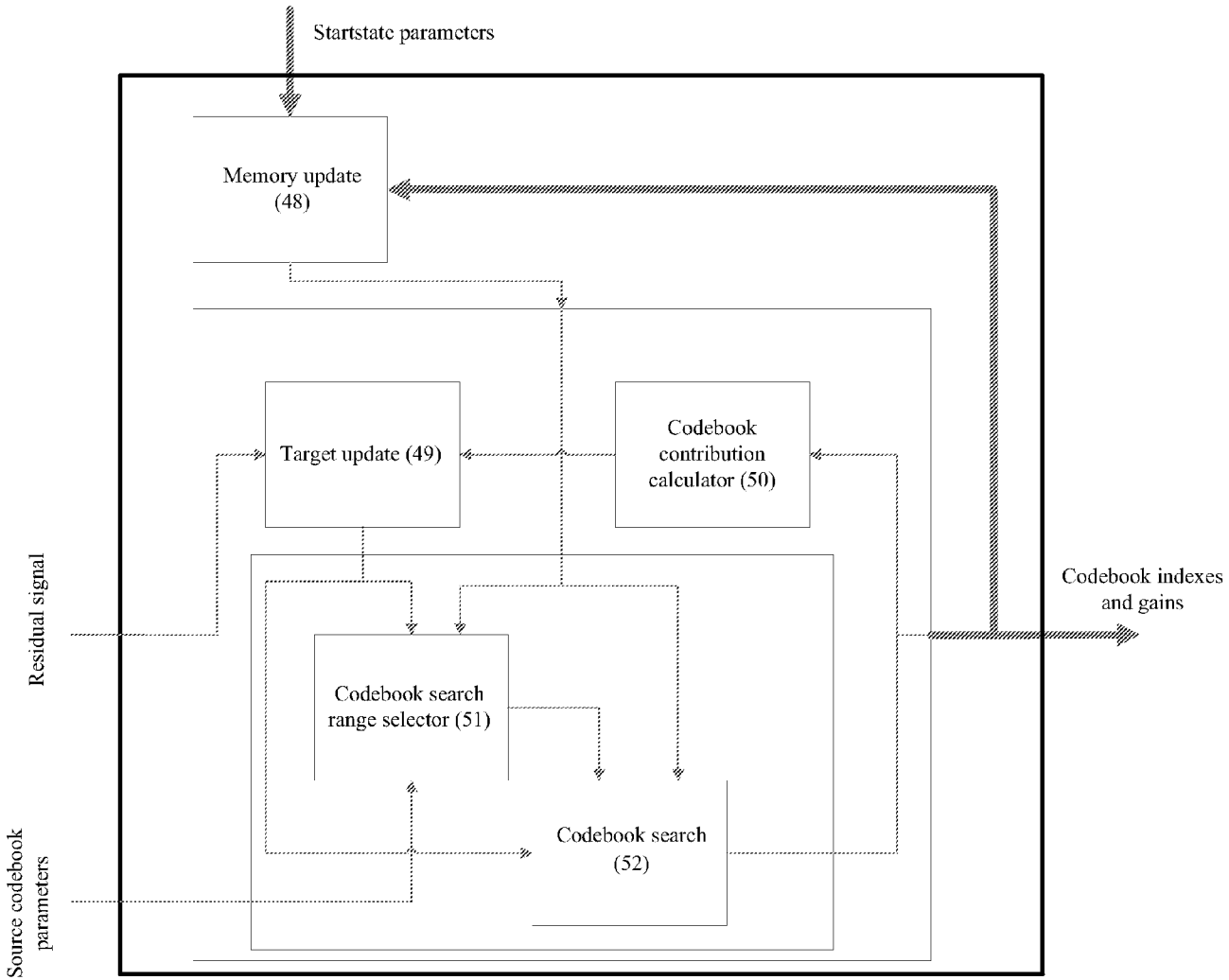
FIG. 7 is a block diagram illustrating a multistage codebook parameter calculation module according to an embodiment of the present invention.

FIG. 7 illustrates the generation of multistage adaptive codebook indexes and gains. After the Start state has been identified and quantized, the codebook memory for constructing the adaptive codebook is initialized for a frame using the Start state itself. The target signal is then initialized by a sub-block of residual signal samples in the same frame. Ranges for the codebook search are selected based on the target signal, the codebook memory and/or the source codebook parameters. A codebook is then constructed from the codebook memory. The constructed codebook vectors within the selected search ranges are searched to locate the codebook vector that best represents the target signal. The codebook index for that search is obtained from the location of the selected vector. The associated codebook gain is calculated in the same manner as the iLBC encoder. The obtained codebook index and codebook gain are then used to calculate the contribution of the current stage codebook. This codebook contribution is subtracted from the target signal to prepare for subsequent stages of codebook search for a sub-block of residual signal samples.

After the codebook indexes and codebook gains for all stages are computed for a sub-block of residual signal samples, they are used to update the codebook memory for the encoding of subsequent residual signal sub-blocks in the frame. The same operation is performed for all residual signal sub-blocks other than the Start state in a frame. Then the resulting multistage codebook indexes and gains for all sub-blocks are sent to bitstream wrapping.

Figure 8:
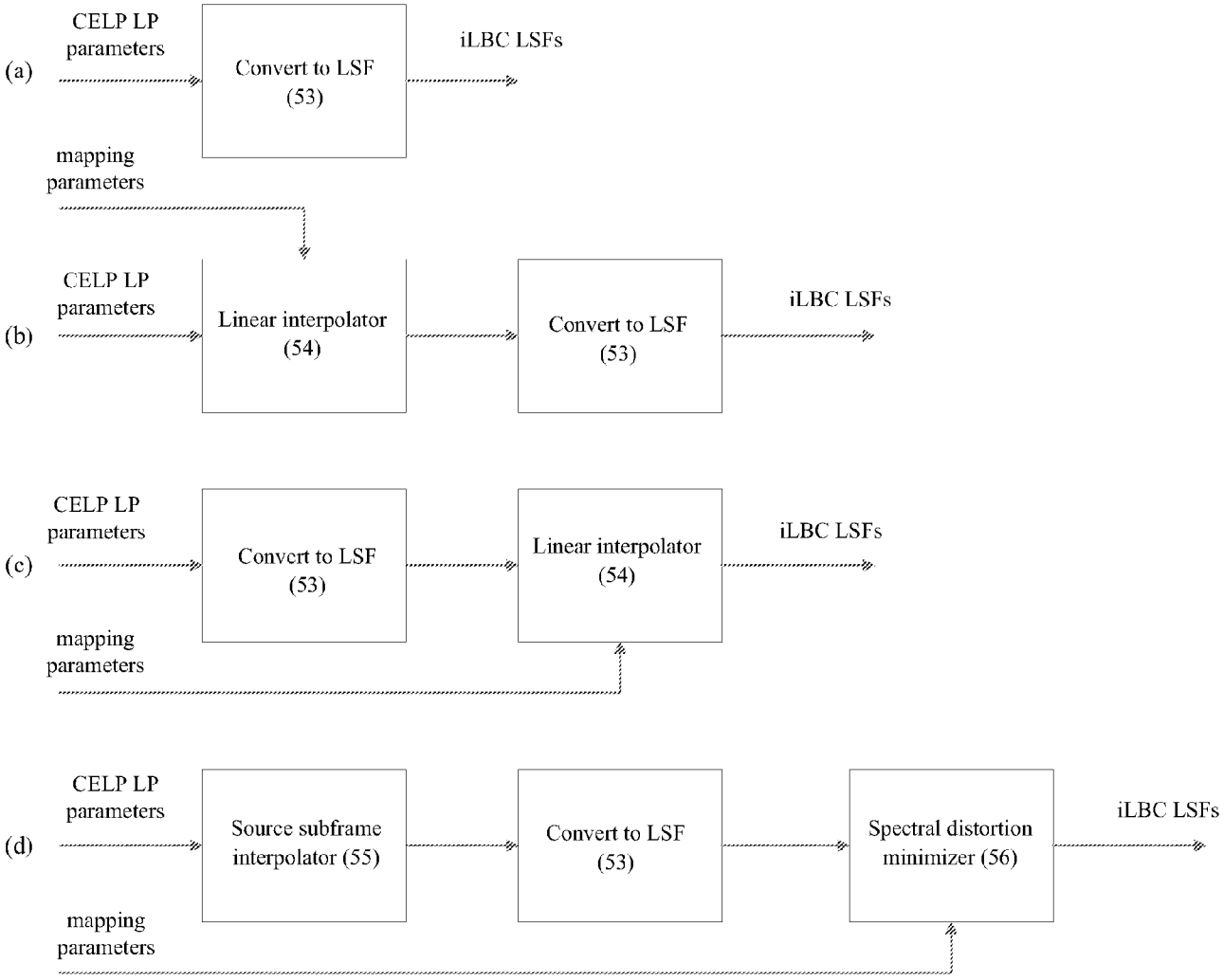
FIG. 8 illustrates a number of strategies of LP parameter mapping between CELP codec and a hybrid codec: (a) Direct copy, (b) linear interpolation in source LP parameter domain, (c) linear interpolation in LSF domain, (d) spectral distortion minimization in LSF domain according to embodiments of the present invention.

Four mapping strategies for the mapping of the LP parameters are illustrated in FIG. 8. One of four mapping strategies is applied in the LP calculation and the strategy selection is determined by either a predefined system configuration or input CELP parameters classification dynamically, such as voice, silence signals, pitch lag and signal energies etc.

In the simplest method, shown in 8*a*), the iLBC LSFs (Line Spectral Frequencies) are obtained by merely converting the appropriate source LP parameter set to an LSF domain.

A more sophisticated approach, shown in 8*b*) and 8*c*), obtains the iLBC LP parameter by linear interpolation between neighboring source LP parameters. Since the source LP parameters may have a representation other than the LSFs, a conversion of LP parameter representation may be necessary. Depending on the order of the LP parameter representation conversion and the linear interpolation, one may have two different implementations of the LP mapping by linear interpolation method. These two different implementations may demonstrate different properties in terms of their computational complexities and speech qualities.

A more advanced technique for obtaining the destination LP parameters, shown in 8*d*), is by explicit spectral distortion minimization. Different measures of spectral distortion can be used for minimization. This technique has a clear theoretical interpretation, and allows a flexible choice of mapping structure via an explicit control of the spectral distortion. Although it is possible to exchange the order of the LP parameter representation conversion and the spectral distortion minimizer, it is computationally more desirable to have the spectral minimization following the LP parameter representation conversion because every candidate destination LP parameter set has to be converted to the source LP parameter domain.

The iLBC codebook parameters are calculated in essentially two steps: firstly, a section of the frame is selected as the Start state and encoded by scalar quantization; then the remaining signal sub-blocks of the frame is encoded with a 3-stage adaptive codebook initialized with the quantized Start state samples. The source adaptive codebook index can be used to limit the search range in the iLBC first stage adaptive codebook search. Moreover, the source compression parameter may contain information that can be used in speeding up the search for the Start state. These are source codec specific and will be demonstrated by examples provided in further exemplary embodiments throughout the present specification.

As part of this invention, novel fast adaptive codebook techniques may be used to reduce the computational requirements for obtaining the second and third stage codebook parameters. This is made possible by the relative lower importance of the second and third stage codebook contributions as compared to the first stage contribution.

One alternative method is to simply reduce the size of the second and third stage codebook through the removal of vectors that may be considered redundant using some measure, or even by randomly removing some vectors from a "well behaved" (as in close to periodic) codebook.

Figure 9:
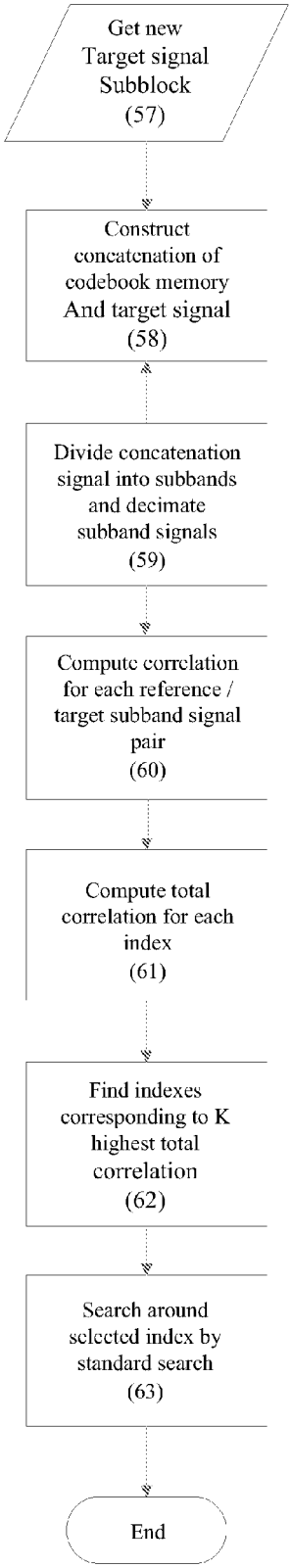
FIG. 9 is a flowchart illustrating a sub-band search based codebook search range selection procedure according to an embodiment of the present invention.

FIG. 9 shows a flowchart for another more advanced method (referred to as sub-band search). This method separates the correlation between the reference signal and the target signal into sub-bands. With the signals divided into sub-bands, they can be decimated before the correlations are calculated, which gives computational savings approximately on the order of the number of sub-bands. After the indexes corresponding to a preset number of highest sub-band correlation are identified, a standard search over small regions around these indexes can be performed to refine the sub-band search result. Note this method may be applied to general adaptive codebook searches and is not limited in scope to bitstream conversion.

Yet another method is by reorganizing the codebook. A method to allow searching fewer codebook vectors in the second and third stages is to re-organize the codebook to be searched such that only small segments would then be searched. Re-organization in this case must be in terms of a reference signal. The logic behind this is as follows: the codebook search in iLBC is searching for signals (or vectors) that display high second order statistical similarity (that is why the normalized cross correlation is being maximized); hence, if a reference signal is used where the similarity of the reference signal to the codebook vector is determined and the similarity of the reference vector to the target vector is determined, then the level of similarity can be compared and this level can be used in the selection of the codebook vector. An embodiment of the present invention is described in the following pseudo code:

```
For stage i=0. . .2
    IF i==0
        For all codebook vectors j=0. . .(K−1)
        Calculate the correlation between the target (reference)
vector and the codebook vector.
        Calculate a similarity measure between the reference vector
and the codebook vector
        Store the correlation.
        Calculate the gain.
        IF the correlation is maximum AND the gain is below the
maximum allowed.
            Select i as the index.
            Save the gain.
        END
    END
```

-continued

```
    Sort the similarity measure results (store the original indexes).
    ELSE
        Calculate the correlation between the target (reference)
vector and the codebook vector.
        Search for the closest similarity point (location).
        (search through indices location −M/2...location+M/2 for best
result).
        Save best index and gain.
    END
        END
```

Note that this method can also be applied to general adaptive codebook search and its scope is not limited to bitstream conversion.

Figure 10:
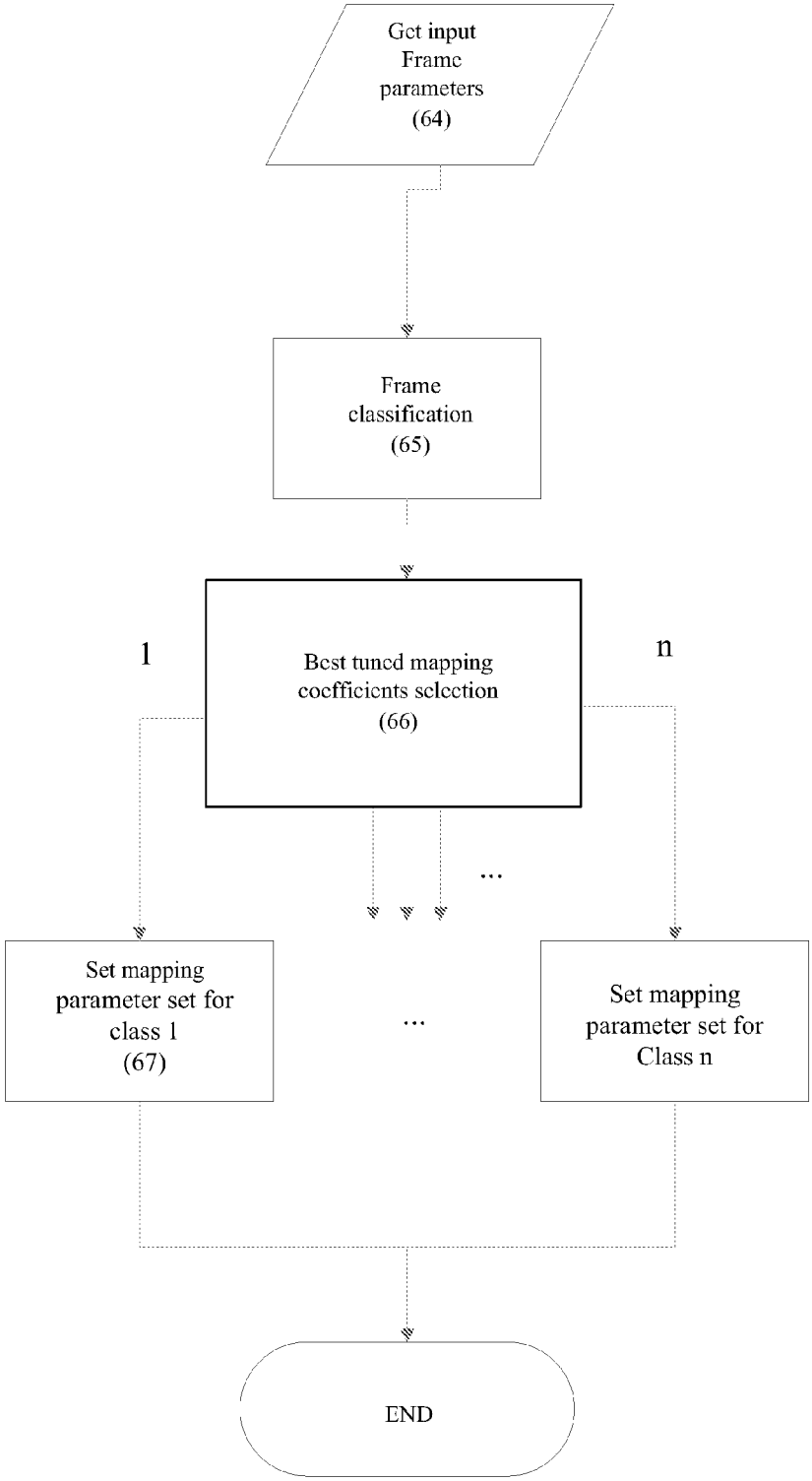
FIG. 10 illustrates a mapping parameter selection method according to an embodiment of the present invention.

It has been reported in the literature that the perceptual weighting filter in the codebook parameter conversion can be fine tuned to improve the performance of the transcoder. Moreover, when the LP parameters are converted using the linear interpolation method, it adds one more degree of freedom that can be tuned. By jointly fine tuning these two parameters, one can further improve speech quality. The optimum sets of these predefined mapping coefficients can further improve the transcoded audio quality without increased computation. The optimum mapping coefficients for male and female speech signals are different, a frame classification can be applied to determine input signals, and optimized mapping coefficients can be applied to get further transcoded audio quality improvement. Based on this, a method for frame classification from input parameters and selecting the mapping parameters is set forth as shown in FIG. 10.

Figure 11:
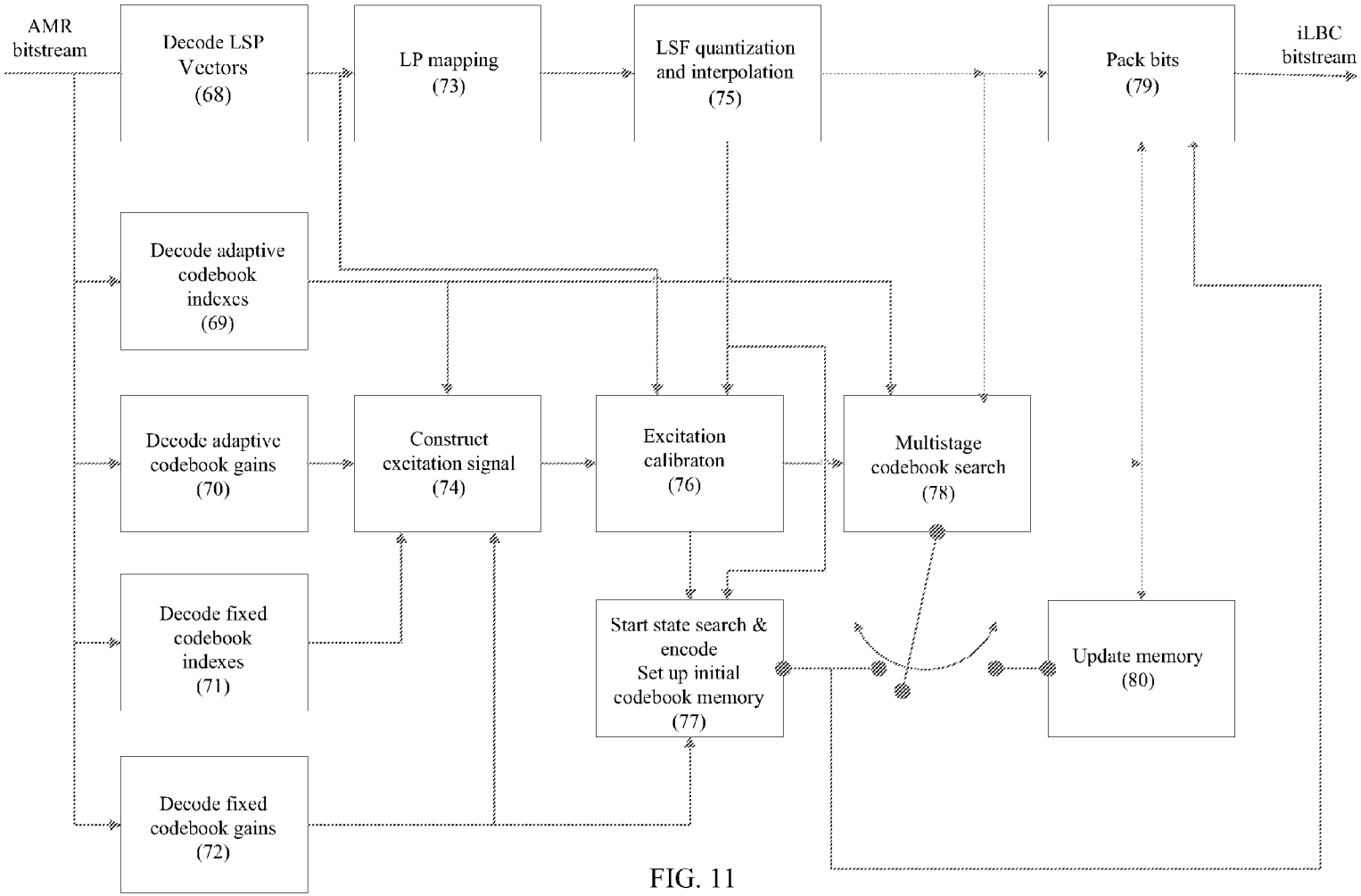
FIG. 11 is a system level block diagram illustrating conversion from an AMR bitstream to an iLBC 20 ms bitstream according to an embodiment of the present invention.

FIG. 11 shows an exemplary transcoder for converting an AMR bitstream to an iLBC 20 ms bitstream. An external controller and a mapping parameter selection module are not shown in the figure. Because both the source and the destination bitstreams have the same frame size, no frame interpolator is needed. The fast localization of the two subframes containing the Start state and the selection of candidate codebook indexes for first stage codebook search range restriction, which are specifically designed for the source/destination codec pair, are set forth in FIG. 12 and FIG. 13.

Figure 12:
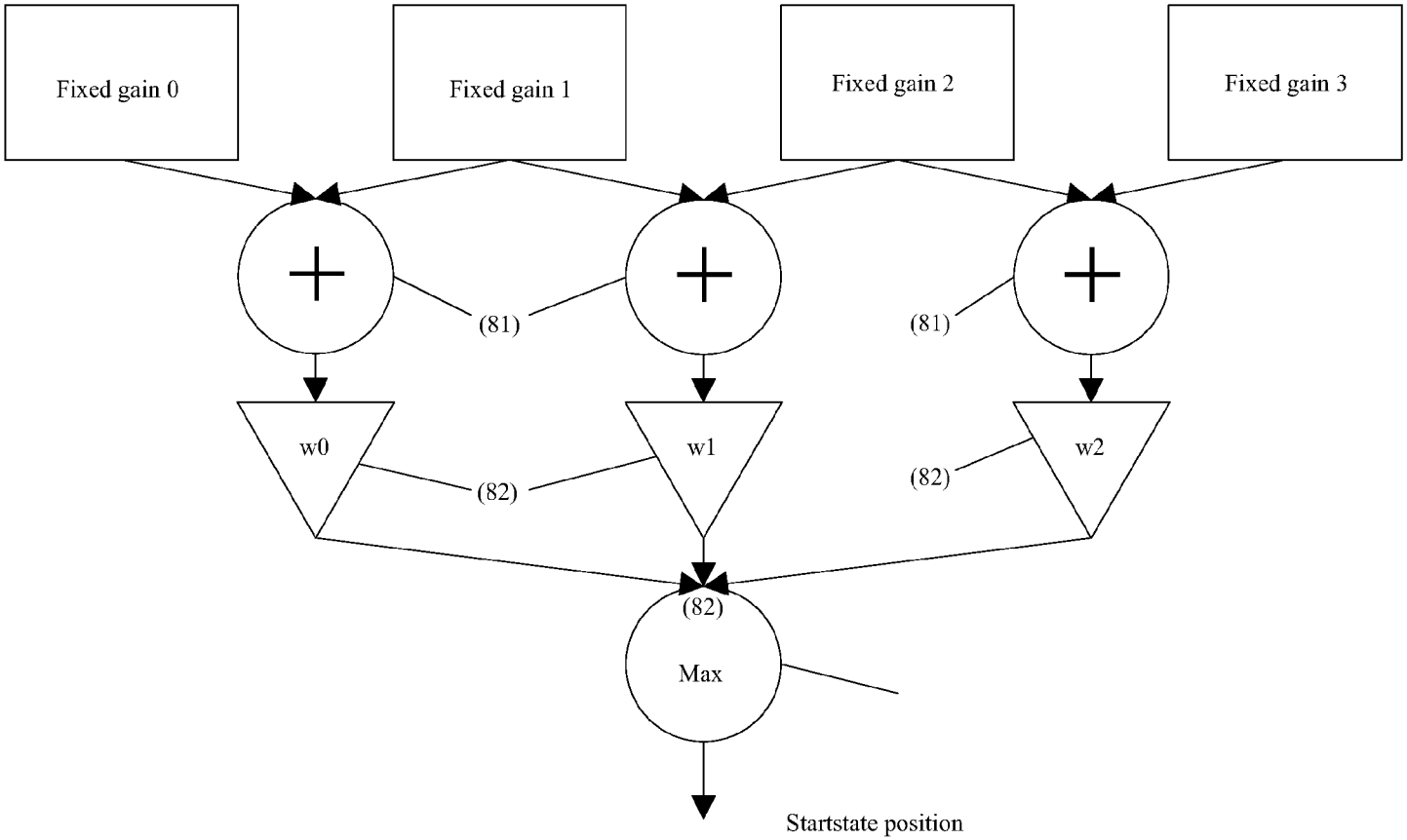
FIG. 12 is a diagram illustrating Start state localization using fixed codebook gains that may be used in the exemplary embodiment illustrated in FIG. 11.

FIG. 12 shows a method for the fast identification of the two sub-frames containing the Start state with the information of the AMR fixed codebook gains. One application of the method can be conveniently described by the following mathematical optimization:

$$k_{opt} = \underset{k}{\operatorname{argmax}}(g_{f,k} + g_{f,k+1})w_k,$$

where $w_0=w_2=0.9$ and $w_1=1$ are example weights that can be used to bias the peak search toward the centre of the frame.

Figure 13:
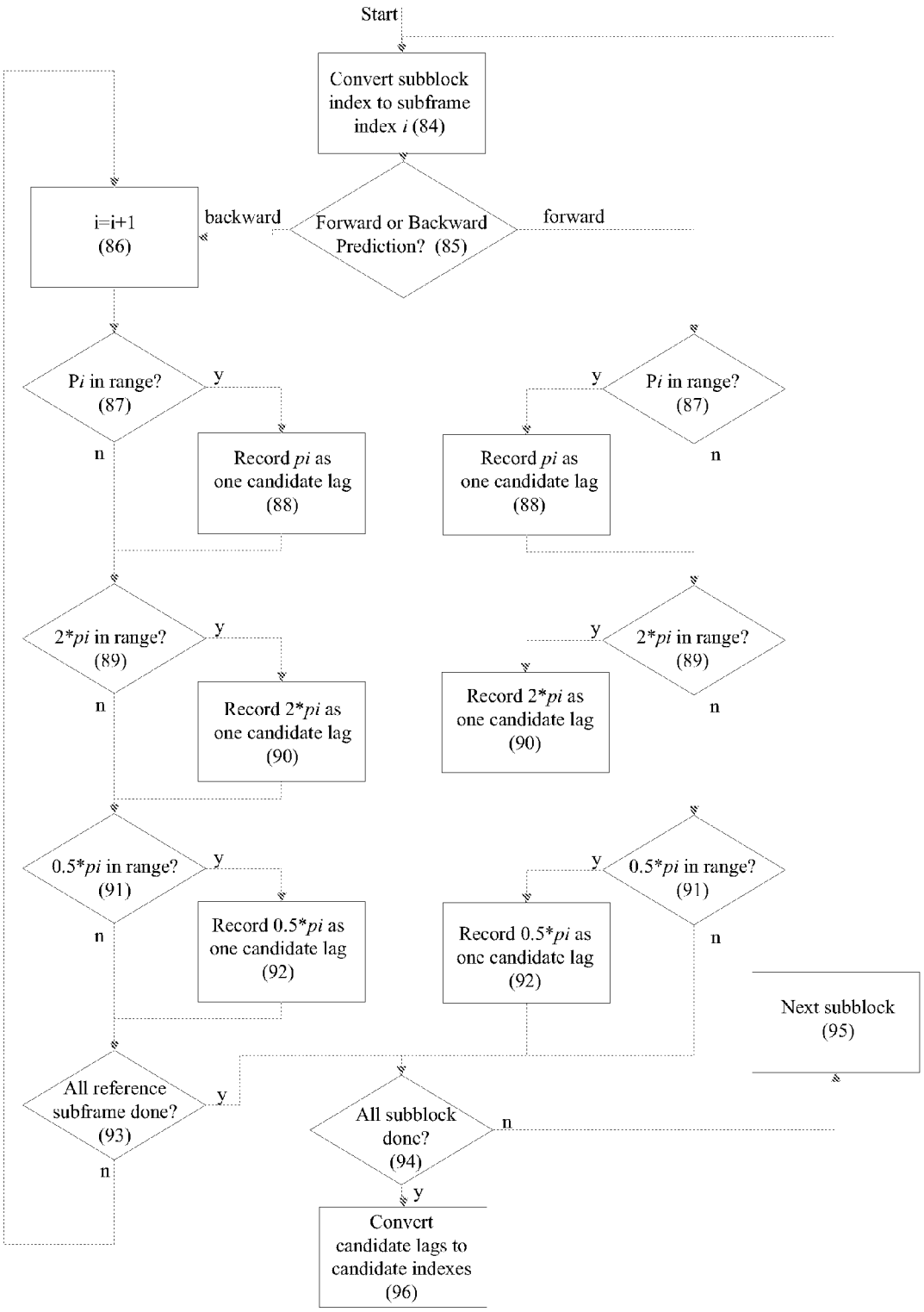
FIG. 13 is a flowchart illustrating a candidate index selection procedure that may be used to limit the iLBC first stage codebook search in the exemplary embodiment illustrated in FIG. 11.

FIG. 13 illustrates a method for selecting the candidate codebook indexes for first stage codebook search range restriction based on AMR adaptive codebook indexes. For each sub-block of the target signal, it is determined whether the sub-block is a forward predicted sub-block (i.e., the sub-block follows its reference signal in time) or a backward predicted sub-block (i.e., the sub-block leads its reference signal in time).

Forward Predicted Sub-Blocks

For forward predicted sub-blocks, both the iLBC index for the sub-block and the AMR index for the subframe containing the sub-block point to signal segment in the past. It is plausible that the AMR index can be used as the iLBC index after necessary conversion. The conversion is needed to account for the different organization of codebook vectors in the iLBC codebook and the AMR codebook. However, the reference signal segment for a sub-block of target signal in iLBC can be substantially shorter than that in AMR. It is therefore necessary to make sure the AMR index points to some section within the iLBC reference signal segment. Moreover, to account for the possible pitch doubling and pitch halving, the double and the half of the AMR index are also checked. If they fall in the range of the iLBC codebook, they are stored as candidate indexes after conversion.

Backward Predicted Sub-Blocks

For backward predicted sub-blocks, each subframe in the iLBC reference signal segment (referred to as a reference subframe) is tested. For each reference subframe any one of the AMR adaptive codebook index, its double or its half is stored as a candidate iLBC index after conversion if it points to the iLBC target signal.

Although the above description has many specifics, these should not be interpreted as limiting the scope of the present invention but as merely providing an example embodiment of the invention. Thus the scope of the invention should be determined by the made claims and their legal equivalents, rather than by the embodiments described.

While the invention has been described in connection with specific embodiments, these embodiments are not intended to limit the scope of the invention to the particular form set forth, but on the contrary, are intended to cover such alternatives, modifications, and equivalents as may be included within the spirit and scope of the invention as defined by the appended claims.

What is claimed is:

1. An apparatus for transcoding an audio signal between a CELP-based coder and a hybrid coder, the apparatus comprising:

a source bitstream unwrapper configured to:

receive a source bitstream;

extract one or more CELP compression parameters from the source bitstream; and construct an audio signal vector from the source bitstream while maintaining the one or more extracted CELP compression parameters;

a frame interpolator coupled to the source bitstream unwrapper, the frame interpolator being configured to interpolate the one or more extracted CELP compression parameters and the constructed audio signal vector between a source frame rate and a destination frame rate and a source subframe rate and a destination subframe rate;

a compression parameter converter coupled to frame interpolator, the compression parameter converter being configured to calculate output compression parameters from at least one of the interpolated compression parameters or the one or more extracted CELP compression parameters;

a destination bitstream wrapper coupled to the compression parameter converter, the destination bitstream wrapper being configured to construct a destination bitstream; and a mapping parameter tuner coupled to the frame interpolator, the mapping parameter tuner being configured to select one or more parameters for use by the compression parameter converter.

2. The apparatus of claim 1 further comprising an external controller.

3. The apparatus of claim 1 wherein the frame interpolator comprises a single module or multiple modules.

4. The apparatus of claim 1 wherein the destination bitstream wrapper comprises a single module or multiple modules.

5. The apparatus of claim 1 wherein the mapping parameter tuner comprises a single module or multiple modules.

6. The apparatus of claim 1 wherein the compression parameter converter comprises a single module or multiple modules.

7. The apparatus of claim 1 wherein the source bitstream unwrapper comprises:

an LP parameter decoder;

an adaptive codebook gain decoder;

an adaptive codebook vector decoder;

a fixed codebook gain decoder;

a fixed codebook vector decoder; and an excitation constructor and memory updater coupled to the adaptive codebook gain decoder and the fixed codebook gain decoder, the excitation constructor and memory updater being configured to construct and output an excitation signal.

8. The apparatus of claim 7 further comprising a synthesis filter coupled to the excitation constructor and the LP parameter decoder, the synthesis filter being configured to construct an audio signal vector based on LP parameters and the excitation signal.

9. The apparatus of claim 1 wherein the frame interpolator comprises:

a source compression parameter buffer configured to hold the one or more extracted CELP compression parameters for interpolation;

an audio signal vector buffer configured to hold one or more audio signal vectors for interpolation;

a source compression parameter selector coupled to the source compression parameter buffer, the source compression parameter selector being configured to select source compression parameters from the source compression parameter buffer;

an output audio signal vector constructor coupled to the audio signal vector buffer, the output audio signal vector constructor being configured to construct an intermediate audio signal vector from the audio signal vector buffer.

10. The apparatus of claim 1 wherein the compression parameter converter comprises:

an LP parameter calculator configured to:

compute and quantize one or more destination LP parameters from one or more input source LP parameters;

output the one or more destination LP parameters; and output one or more destination LP parameter quantization indices; and a codebook parameter calculator configured to compute and quantize one or more destination codebook parameters.

11. The apparatus of claim 10 wherein the codebook parameter calculator utilizes the one or more extracted CELP parameters, the output audio signal vector from the frame interpolator, and the one or more destination LP parameters to compute one or more destination codebook parameter quantization indices.

12. The apparatus of claim 10 wherein the LP parameter calculator comprises:

a LP parameter converter configured to convert one or more source LP parameters to one or more destination LP parameters using one of a plurality of LP parameter conversion strategies;

a LP parameter quantizer coupled to the LP parameter converter, the LP parameter quantizer being configured to quantize one or more destination LP parameters using one or more of a plurality of LP parameter quantization strategies and output one or more quantized LP parameters and to output one or more LP parameter quantization indices for destination bitstream wrapping; and a subframe interpolator coupled to the LP parameter quantizer, the subframe interpolator being configured to interpolate and output one or more destination LP parameters for each subframe in a frame.

13. The apparatus of claim 12 wherein the plurality of LP parameter conversion strategies comprises:

a direct transfer process;

linear interpolation of the one or more source LP parameters;

linear interpolation of the one or more destination LP parameters; and a spectral distortion minimization process.

14. The apparatus of claim 12 wherein the one or more of a plurality of LP parameter quantization strategies comprise:

vector quantization with an unsorted codebook; and vector quantization with an organized codebook created by sorting an original vector codebook.

15. The apparatus of claim 10 wherein the codebook parameter calculator comprises:

an analysis filter configured to receive the destination LP parameters and an audio signal vector and provide a residual signal vector;

a Start state parameter calculator coupled to the analysis filter, the Start state parameter calculator being configured to quantize one or more Start state parameters using at least the residual signal vector, the one or more destination LP parameters, or one or more codebook parameters from the one or more extracted CELP parameters and output one or more Start state parameters one or more Start state parameter quantization indices; and a multistage codebook parameter calculator configured to compute and quantize one or more multistage codebook parameters from at least the residual signal vector, the one or more destination LP parameters, one or more Start state parameters, or one or more codebook parameters from the one or more extracted CELP parameters and output one or more multistage codebook parameter indices.

16. The apparatus of claim 15 wherein the Start state parameter calculator comprises:

a Start state locator configured to:

receive the codebook parameters from the one or more extracted CELP parameters;

receive a residual signal;

determine a Start state section of a frame of the residual signal using one of a plurality of strategies;

output an index to a first of two subframes containing the Start state;

output a flag indicating whether the Start state is located at a beginning or an end of the two subframes;

output quantized values of Start state signal samples; and output Start state signal sample quantization indices; and a Start state quantizer coupled to the Start state locator and configured to quantize the Start state section and output a quantized Start state scale, a plurality of scaled Start state signal sample values, a Start state scale quantization index, and a plurality of scaled Start state signal sample quantization indices.

17. The apparatus of claim 16 wherein the plurality of strategies comprise hybrid location strategies and residual signal domain location strategies.

18. The apparatus of claim 15 wherein the multistage codebook parameter calculator comprises:

a memory setup and update module configured to setup or update a codebook memory from which a codebook is constructed based on an encoded section of the residual signal vector in a current frame;

a multistage codebook search module, the multistage codebook search module being configured to search the codebook for three stage indices and gains for each sub-block of the residual signal in a frame, output the three stage indices and gain quantization indexes for use in encoding subsequent signal sub-blocks.

19. The apparatus of claim 18 wherein the multistage codebook search module comprises:

a search range selection module configured to set a range for a stage of a codebook search based on one or more codebook parameters from the one or more extracted CELP parameters, a target signal vector for a current stage of a current signal sub-block, and the codebook memory using one or more of a plurality of search range selection strategies;

a codebook search module configured to search a codebook setup with the codebook memory using one of a plurality of strategies for the codebook vector that represents the target signal vector to output a target signal vector index and a quantization index of the corresponding codebook gain; and a target update module configured to update the target signal vector for subsequent stages of codebook search based on an output of the codebook search module.

20. The apparatus of claim 19 wherein the search range selection strategies comprise:

source bitstream compression parameter domain based selection;

sub-band domain based selection; and reduced frame size based selection.

21. The apparatus of claim 19 wherein the codebook search module comprises:

a full search module; and a reduced set search module configured to extract and search a sub-set of codebook vectors using a similarity measure from a codebook to be searched.

22. The apparatus of claim 1 wherein the compression parameter converter is configured to calculate the output compression parameters using the constructed audio signal.

23. The apparatus of claim 1 wherein the compression parameter converter is configured to calculate the output compression parameters without using the constructed audio signal.

24. The apparatus of claim 1 wherein the source subframe rate and the destination subframe rate are a same rate.

25. The apparatus of claim 1 wherein the hybrid coder is an iLBC coder.

26. A method of converting a CELP based bitstream to an iLBC bitstream, the method comprising:

processing the source CELP bitstream to extract one or more CELP compression parameters from the source CELP bitstream;

synthesizing audio signal vectors from the CELP compression parameters;

aligning source and destination frame timing if the CELP based bitstream and the iLBC bitstream are characterized by at least one of a different frame rate or a different subframe rate;

selecting one or more algorithmic parameters for use in a destination compression parameter calculation based on the one or more CELP compression parameters and the synthesized audio signal vectors;

calculating and quantizing one or more destination compression parameters using the one or more CELP compression parameters and the synthesized audio signal vectors; and wrapping the one or more destination compression parameters to provide the iLBC bitstream.

27. The method of claim 26 further comprising:

converting one or more source LP parameters to one or more destination parameters using one or more methods including direct transfer, linear interpolation in a source parameter domain, linear interpolation in a destination parameter domain, and spectral distortion minimization; and quantizing one or more destination LP parameters using vector quantization with either an unsorted codebook or a sorted, organized, and reduced-size codebook.

28. The method of claim 27 wherein the method of direct transfer comprises:

converting the one or more source LP parameters from a source domain to a destination domain; and using the one or more converted LP parameters in the destination domain as the one or more destination LP parameters.

29. The method of claim 27 wherein the linear interpolation comprises:

performing linear interpolation between neighboring source LP parameters to obtain one or more interpolated LP parameters in a source domain;

converting the interpolated LP parameters to a destination domain to obtain the one or more destination LP parameters.

30. The method of claim 27 wherein linear interpolation comprises:

converting the one or more source LP parameters to a destination domain; and performing linear interpolation between neighboring converted source LP parameters to obtain one or more destination parameters.

31. The method of claim 27 wherein spectral distortion minimization comprises:

converting the one or more source LP parameters to a destination domain; and finding one or more destination LP parameters to minimize a pre-defined spectral distortion measure using an optimization technique.

32. The method of claim 31 wherein the pre-defined spectral distortion measure is defined based on a specific source-destination bitstream pair.

33. The method of claim 27 wherein vector quantization with the sorted, organized, and reduced-size codebook comprises:

sorting a vector quantization codebook according to a similarity measure between codebook vectors and a reference vector;

calculating a similarity measure between a target vector and the reference vector;

searching the vector quantization codebook in a range within which the codebook vectors have similarity measures similar to the target vector.

filtering one or more audio signal vectors with one or more LP filters specified by one or more destination LP parameters to obtain one or more residual signal vectors;

locating one or more Start state sections in one or more residual signal vectors using either a residual domain search method or a hybrid search method;

quantizing one or more Start state sections in one or more residual signal vectors; and calculating one or more multistage codebook parameters for the remaining sections in one or more residual signal vectors.

34. The method of claim 33 wherein the hybrid search method comprises:

identifying an index of a first of two consecutive subframes containing the Start state using one or more source compression parameters;

determining if a leading or an ending section of a predefined length in the two consecutive subframes has a higher energy; and defining the higher energy section as the Start state.

35. The method of claim 33 wherein calculating one or more multistage codebook parameters comprises:

updating a memory with the encoded sub-blocks of a residual signal vector for codebook setup; and searching a multistage codebook to obtain one or more codebook parameters for a target signal vector.

36. The method of claim 35 wherein searching the multistage codebook comprises:

selecting a codebook search range using a source compression parameter based selection method or a sub-band search based selection method;

searching the codebook through the selected range for the codebook index and gain for a stage;

quantizing the codebook gain;

calculating codebook contribution for the stage; and updating the target signal vector by subtracting the codebook contribution of the stage from the target vector.

37. The method of claim 36 wherein the source compression parameter based selection method comprises:

optionally converting one or more source adaptive codebook indices to one or more source lags;

quantizing the one or more source lags using destination lag resolution;

selecting one or more candidate destination lags based on the one or more source lags;

setting one or more lag ranges for a codebook search based on the one or more candidate destination lags; and optionally converting the one or more lag ranges to destination index ranges to obtain the codebook search range.

38. The method of claim 36 wherein searching the codebook comprises:

calculating a similarity measure for each codebook vector with a reference vector;

calculating a similarity measure between a target signal vector and a reference vector;

identifying codebook vectors of similar similarity measure to the target signal vector; and searching among the codebook vectors identified in the previous step to obtain codebook index and codebook gain.

39. The method of claim 36 wherein the sub-band search based selection method comprises:

concatenating a codebook memory and a target signal vector to form a concatenation vector;

filtering the concatenation vector with a bank of filters of non-overlapping pass-bands to obtain a filtered concatenation vector for every filter in the bank of filters;

extracting a filtered codebook memory and a filtered target signal vector from corresponding sections of every filtered concatenation vector;

constructing a sub-band codebook from a filtered codebook memory;

constructing a sub-band target signal vector by setting every other element in a filtered target signal vector to zero;

calculating a sub-band correlation of a sub-band codebook index in one or more sub-bands between the sub-band target signal of the sub-band and the codebook vector of the index in the sub-band codebook for the sub-band;

calculating the total correlation for every sub-band codebook index by calculating the weighted sum of the sub-band correlations of the sub-band codebook index;

recording the one or more sub-band codebook indices corresponding to the one or more highest total correlations;

converting the selected sub-band codebook indices to the corresponding destination codebook indexes to obtain the candidate destination codebook indices, if necessary; and setting one or more search ranges for one or more candidate destination codebook indices.

* * * * *